US005487478A

United States Patent [19]

Morrow

[11] Patent Number: 5,487,478

[45] Date of Patent: Jan. 30, 1996

[54] INVERTED KINGPOST CRANE

[76] Inventor: William D. Morrow, 13223 Spencer Rd., Houston, Tex. 77041

[21] Appl. No.: 323,857

[22] Filed: Oct. 17, 1994

[51] Int. Cl.[6] ..... B66C 23/84

[52] U.S. Cl. ..... 212/253; 212/223

[58] Field of Search ..... 212/253, 228, 212/223

[56] References Cited

U.S. PATENT DOCUMENTS

| | | | |
|---|---|---|---|
| 2,828,872 | 4/1958 | Mangel | 212/228 |
| 2,998,149 | 8/1961 | Bopp | 212/228 |
| 4,061,230 | 12/1977 | Goss et al. . | |
| 4,184,600 | 1/1980 | Goss et al. | 212/253 |
| 4,216,870 | 8/1980 | Bonneson et al. . | |
| 4,354,606 | 10/1982 | Morrow et al. | 212/253 |
| 4,511,048 | 4/1985 | Volakakis et al. | 212/253 |
| 4,513,869 | 4/1985 | Goudy . | |
| 4,688,688 | 8/1987 | Volakakis et al. | 212/253 |
| 5,310,067 | 5/1994 | Morrow . | |
| 5,328,040 | 7/1994 | Morrow . | |

FOREIGN PATENT DOCUMENTS

| | | | |
|---|---|---|---|
| 10730 | of 1894 | United Kingdom . | |
| 680507 | 10/1952 | United Kingdom . | |
| 1167821 | 10/1969 | United Kingdom . | |
| 1179174 | 1/1970 | United Kingdom . | |
| 1179175 | 1/1970 | United Kingdom . | |
| 2177374 | 1/1987 | United Kingdom | 212/253 |

*Primary Examiner*—Michael S. Huppert
*Assistant Examiner*—Thomas J. Brahan
*Attorney, Agent, or Firm*—Keeling Law Firm

[57] ABSTRACT

An inverted kingpost crane is disclosed, the crane including an upperworks supporting a crane boom, the upperworks supported on a rotating kingpost, the kingpost supported in a sleeve, an upper radial bearing structure intermediate an upper section of the kingpost and the sleeve, a lower bearing structure comprising a thrust bearing and a radial bearing disposed intermediate a lower section of the kingpost and the sleeve. The upper bearing and the lower bearing structure are constructed of a relatively soft bearing material, the bearing material providing a sacrificial wearing surface between the rotating kingpost and the stationary sleeve.

20 Claims, 3 Drawing Sheets

INVERTED KINGPOST CRANE

FIELD OF THE INVENTION

This invention relates to the field of cranes and particularly to a novel type of kingpost crane.

BACKGROUND OF THE INVENTION

Kingpost cranes have long been known in the art. See for instance Purdy, GB Patent No. 10730, AD-1894. Pedestal crane systems, in which a crane upper works is rotatably mounted on a pedestal, have gained widespread acceptance in the marine industry. A form of pedestal crane in which a central kingpost is mounted on a pedestal and the upper works is rotatable about the kingpost and is supported, at least in part, on the kingpost is described in U.S. Pat. No. 4,184,600 issued to Goss and this applicant.

Kingpost cranes of the type described in the '600 patent and subsequent patents such as U. S. Pat. Nos. 5,328,040 and 5,310,067 issued to this applicant and U.S. Pat. No. 4,354,606 to applicant and another have gained widespread acceptance in the offshore oil and gas industry. A primary advantage of such kingpost cranes is the safety inherent in their structure. Such kingpost cranes are highly resistant to overturning moments.

Such kingpost cranes include an upperworks rotatably supported on a kingpost. The structure of such kingpost cranes involves vertical separation of radial bearings. Such separation is normally obtained by providing an upper radial bearing at an upper extension of the kingpost and by providing a lower radial bearing near the level of the pedestal.

Kenz GB Patent No. 2177374A discloses a crane supported on a pivot section, the pivot point disposed below an upper radial bearing. The GB '374A disclosure is for a rope luffed crane, luffing being the adjustment of lateral travel of the block or hook by means of angular adjustment of the boom. The disclosure indicates an advantage of the crane to be an ability to raise the pivot section to allow changing of the upper radial bearing. A disadvantage of the '374 crane is that the '374 crane does not provide means for inspection or replacement of lower radial and thrust bearings without substantial disassembly of the crane. A further disadvantage of the '374A crane is that the lower bearing, like the bearings of many prior art cranes, involves bearing contact of relatively hard metal bearing members with the relatively soft metal of the pivot member. A bearing failure can result in cutting of the pivot member, possibly resulting in overturn of the crane.

It is an object of the present invention to provide a novel kingpost crane having an inverted kingpost.

It is a further object of the present invention to provide an inverted kingpost crane providing upper and lower bearings constructed of relatively soft bearing materials cooperating in bearing relationship with relatively hard kingpost and upperworks structures.

It is a further object of the present invention to provide an inverted kingpost crane providing ready access to upper and lower bearings for inspection and replacement.

SUMMARY OF THE INVENTION

The foregoing and other objects of the present invention are accomplished by an inverted kingpost crane, the crane including an upperworks supporting a crane boom, the upperworks supported on a rotating kingpost, the kingpost extending downwardly into a sleeve, an upper radial bearing structure intermediate an upper section of the kingpost and the sleeve, a lower bearing structure comprising a thrust bearing and a radial bearing disposed intermediate a lower section of the kingpost and the sleeve. The upper bearing and the lower bearing structure are constructed of a relatively soft bearing material, providing a sacrificial wearing surface between the rotating kingpost and the stationary sleeve.

DETAILED DESCRIPTION OF THE INVENTION

Figure 1:
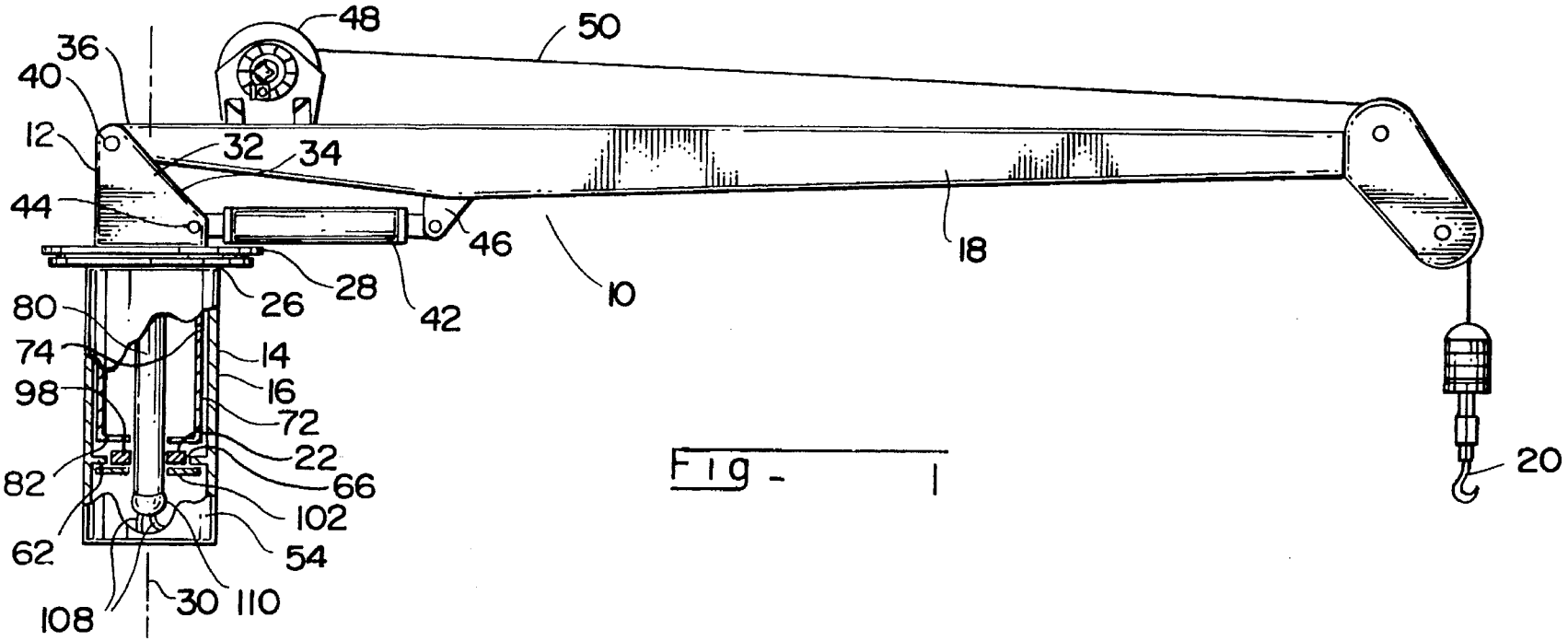
FIG. 1 depicts a partial cross-sectional view of the inverted kingpost crane of the present invention.

Referring to FIG. 1, the inverted kingpost crane 10 of the present invention is depicted in partial cross-section. The crane 10 includes generally an upperworks 12 supported on a kingpost 14, the kingpost 14 supported interior of a vertical sleeve 16. A boom 18 is supported on the upperworks 12, the boom 18 supporting a hook 20.

The kingpost 14 includes an elongated, cylindrical body 72. Kingpost body 72 extends downwardly into cylindrical sleeve 16. The kingpost body 72 and the sleeve 16 are concentrically arranged about vertical axis 30. The kingpost body 72 is rotatable within the sleeve 16, the kingpost 14 supported on a lower bearing structure 22. The lower bearing structure 22 comprises a thrust bearing and a radial bearing. An upper radial bearing structure 24 (not shown in FIG. 1) is provided intermediate the kingpost body 72 and the sleeve 16 near the sleeve upper end 26.

The upperworks 12 includes a turntable 28 supporting parallel, upwardly extending support struts 32. The struts 32 each have an inclined upper edge 34 extending at an acute angle to axis 30. A base end 36 of boom 18 is pivotally attached to the struts 32 at upper pivot connector 40. The pivot connector 40 is attached to the struts 32 at an upper portion of the struts 32 vertically removed from the turntable 28. The boom 18 may be pivoted in a vertical plane about the pivot connector 40.

A hydraulic ram 42 is pivotally connected to the struts 32 at lower pivot connector 44. The hydraulic ram 42 is pivotally connected at its distal end to the boom 18 at connecting ears 46, which connecting ears 46 are fixedly attached to the underside of the boom 18. The boom 18 is angularly adjustable in a vertical plane by the hydraulic ram 42 in cooperation with the pivot connectors 40, 44 and 46.

A hoist 48 is fixedly attached to the boom 18 near the base 36 of the boom 18. Hoist 48 serves to extend and retract a hoist line 50, which hoist line 50 extends to boom sheaves 52 and thence to hook 20. The boom 18, the hydraulic ram 42 and the hoist 48 are of conventional construction. Details of construction of the boom 18, ram 42 and hoist 48 are therefore not depicted. An operator cabin and controls may be provided on the turntable 28 adjacent struts 32. Such cabin and controls have been omitted from the drawings as they are of conventional construction.

Still referring to FIG. 1, sleeve 16 is depicted in partial cross-section. Sleeve 16 is a vertically-oriented, hollow, elongated cylinder having a cylinder wall 54 extending from the underside of the turntable 28 downwardly. The sleeve 16 is attached to a support structure (not shown).

Figure 3:
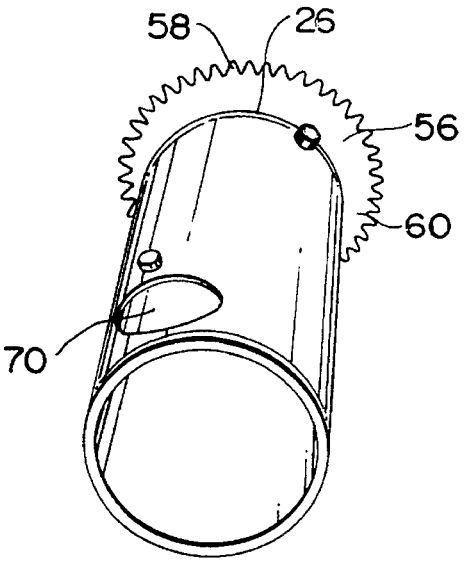
FIG. 3 depicts an isometric view of the sleeve of the kingpost crane of the present invention.

Referring to FIG. 3, an isometric view of sleeve 16 is depicted. A tooth gear 56 is provided at the upper end 26 of sleeve 16. The tooth gear 56 comprises a plurality of teeth 58 extending radially outwardly from a flange 60. The flange 60 extends horizontally from upper end 26.

Figure 4:
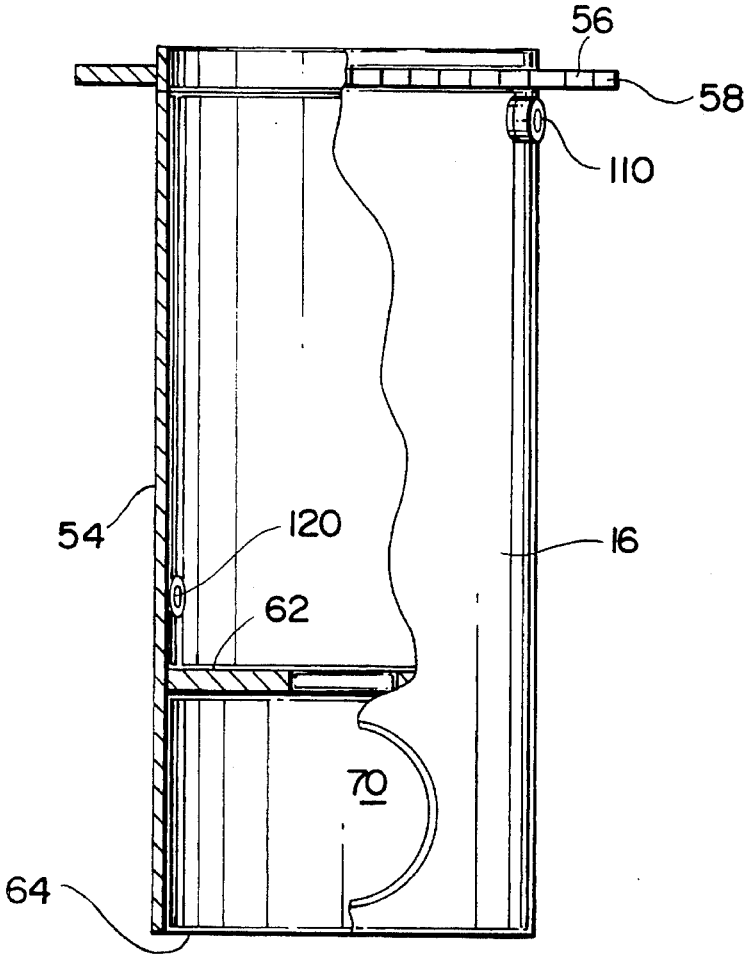
FIG. 4 depicts a cross-sectional view of the sleeve of FIG. 3.

Referring to FIG. 4, a partial cross-sectional side view of the sleeve 16 is depicted. A horizontal cross-member 62 is provided interior of sleeve 16. The horizontal cross-member 62 is positioned in a lower segment of the sleeve 16 spaced from the lower end 64 of the sleeve 16. The cross-member 62 is fixedly attached, such as by welding, to the cylinder wall 54. An opening 70 is provided in the cylinder wall 54 of the sleeve 16 intermediate the cross-member 62 and the lower end 64 of the sleeve 16.

Figure 5:
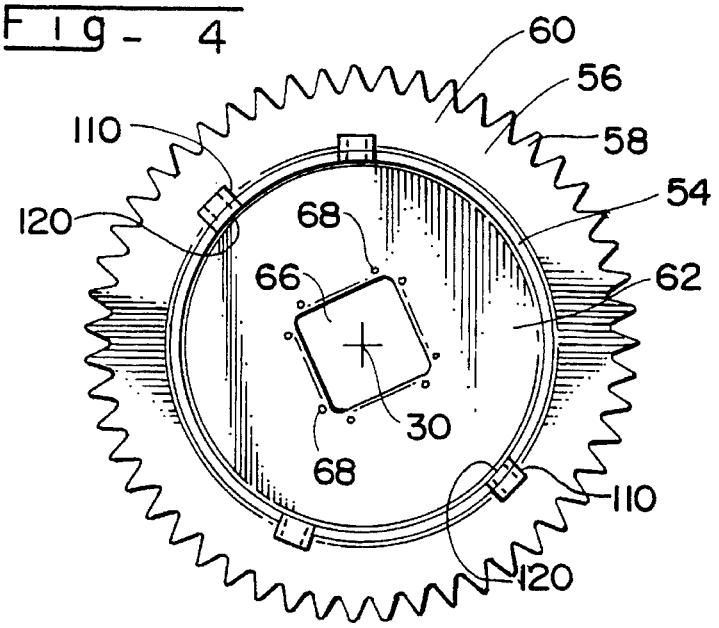
FIG. 5 depicts a bottom view of the sleeve of FIG. 3.

Referring to FIG. 5, a bottom view of the sleeve 16 is depicted. The cross-member 62 is, in the preferred embodiment, a circular plate welded along its periphery to the cylinder wall 54. A square opening 66 is provided in the center of the cross-member 62. The square opening 66 is centered on axis 30. A plurality of bolt holes 68 are provided in the cross-member 62 near the square opening 66 and space around the periphery of the square opening 66.

Figure 6:
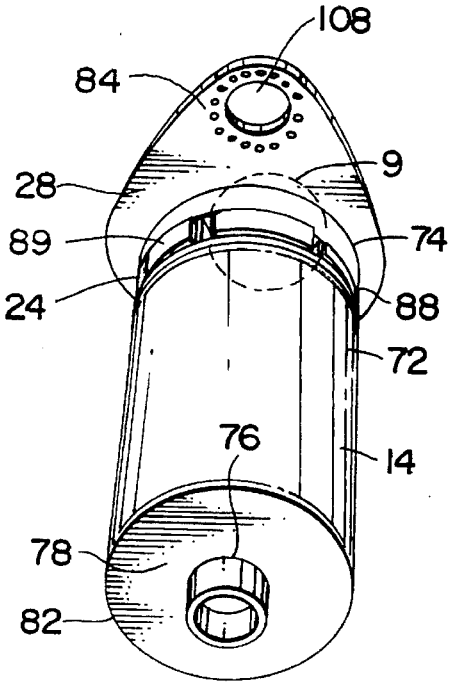
FIG. 6 depicts an isometric view of the kingpost of the present invention.

Referring to FIG. 6, an isometric view of the kingpost 14 of the present invention is depicted. The kingpost 14 includes an elongated cylinder body 72. The kingpost body 72 and the sleeve 16 are constructed with respective diameters such that the kingpost body 72 fits within the sleeve 16 defining an annular opening 74 (depicted in FIG. 1) between the kingpost body 72 and the sleeve 16.

The turntable 28 is fixedly attached, preferably by welding, to the kingpost body 72 at the kingpost body upper end 74.

A cylindrical kingpost pin 76 extends from the kingpost lower end 82. The kingpost pin 76 has a lesser diameter than the kingpost body 72 and is concentrically aligned with the axis 30. A lower end surface 78 is provided on the kingpost 14, the lower end surface 78 extending from cylindrical body 72 lower end 82 to the exterior of the kingpost pin 76. The kingpost lower end surface 78 is fixedly attached, such as by welding, to the kingpost body 72 and to the kingpost pin 76.

In the preferred embodiment depicted, the kingpost pin 76 is an extension of an elongated cylinder 80 (depicted in FIG. 1). The cylinder 80 extends from the upper end 74 of the kingpost body 72 beyond the lower end 82 of the kingpost body 72. The pin cylinder 80 is fixedly attached, preferably by welding, to the underside of turntable 28 at its upper end (not shown). An opening (not shown) in the turntable 28 at the upper end of pin cylinder 80 allows hydraulic hoses to extend interior of pin cylinder 80 between turntable 28 and pin 76.

Referring to FIG. 5 and FIG. 1, the square opening 66 provided in the cross-member 62 is sufficiently large that the kingpost pin 76 extends through such square opening 66. An annular space 82 is defined by the exterior of the kingpost pin 76 within the square opening 66.

Figure 9:
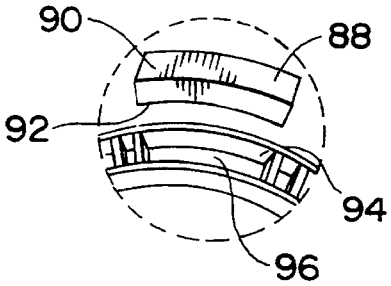
FIG. 9 depicts an upper bearing shoe.

Referring to FIG. 6 and FIG. 9, the upper radial bearing 24 is depicted. The upper radial bearing 24 consists of a plurality of upper radial bearing shoes 88 located near the upper end 74 of kingpost body 72. The bearing shoes 88 are spaced around the circumference of the kingpost body 72 below the upper end 74. The bearing shoes 88 are provided with a curvilinear radially exterior surface 90 and a curvilinear radially interior surface 92. The interior surface 92 is shaped in an arc conforming to an arc defined by a section of the exterior of the kingpost body 72. The exterior surface 90 of each bearing shoe 88 is shaped in an arc conforming to an arc defined by a section of the interior of the cylinder wall 54.

A plurality of bearing housings 94 are provided on the kingpost body 72 to house the bearing shoes 88. The bearing housings 94 comprise a series of generally rectangular boxes 96 extending around the circumference of the kingpost body 72. The boxes 96 so constructed that the bearing shoes 88 fit within the boxes 96 with an exterior segment 89 of the bearing shoes 88 extending radially outward. The exterior surfaces 90 of the bearing shoes 88 extend to a close fit with the interior of cylinder wall 54 of sleeve 16.

Figure 7:
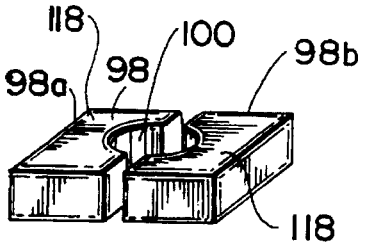
FIG. 7 depicts the lower bearing block of the inverted kingpost crane.

Referring now to FIG. 7 and FIG. 1, the lower bearing 22 is depicted. The lower bearing 22 comprises a segmented rectangular block 98 having a cylindrical opening 100 extending vertically through its center. The bearing block 98 comprises two symmetrical segments **98*a* and 98*b*. Segments 98*a* and 98*b* are symmetrical along a vertical plane extending through the center of the bearing block 98. The bearing block 98 is constructed such that its laterally exterior surfaces fit within the square opening 66 of cross-member 62. The bearing block 98 is further constructed such that its central cylindrical opening 100 extends around the circumference of kingpost pin 76. The bearing block 98 is segmented to allow insertion of each of the segments 98*a* and 98*b* in the respective space between the opening of kingpost pin 76 and square opening 66**.

The bearing block 98 is constructed with a vertical dimension such that the bearing block 98 is vertically thicker than the cross-member 62.

Figure 8:
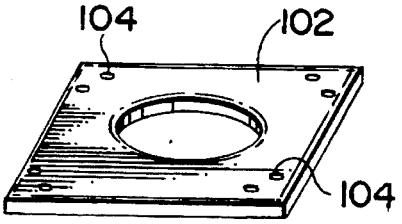
FIG. 8 depicts the bearing retainer for the lower bearing block.

Referring to FIG. 8, a lower bearing retainer 102 is depicted. The lower bearing retainer 102 is a square plate. The lateral dimensions of the bearing retainer 102 are such that the bearing retainer 102 extends beyond the lateral edges of the square opening 66 in the cross-member 62. The bearing retainer 102 is provided with a plurality of bolt holes 104. The bolt holes 104 are constructed of a size and with dimensions to allow alignment with bolt holes 68 exterior of square opening 66 in cross-member 62.

The bearing retainer 102 is bolted to the underside of cross-member 62, the bearing retainer 102 supporting bearing block 98. Upon installation, the upper surface 118 of bearing block 98 extends above the cross-member 62 with the kingpost lower surface 78 resting on the upper surface 118 of bearing block 98. The edges of the square opening 66 retain bearing block 98 in a fixed lateral position.

Figure 2:
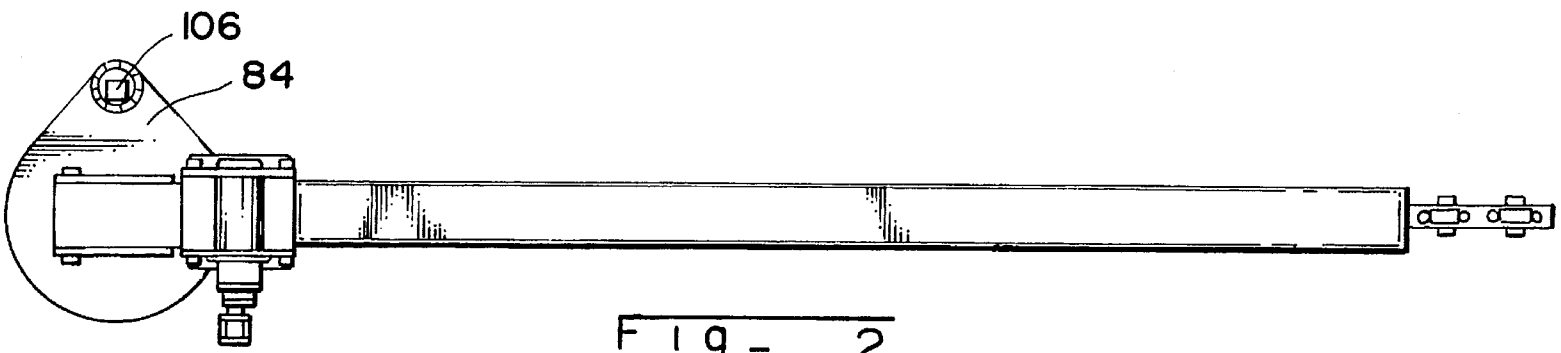
FIG. 2 depicts a plan view of the inverted kingpost crane.

Referring to FIG. 2, a motor 106 is provided on the turntable 28 at a lateral extension 29 of turntable 28. In the preferred embodiment depicted, the motor is hydraulically powered. A spindle (not shown) extends downwardly from the motor 106 through an opening 108 (depicted in FIG. 6)

in the turntable 28. A pinion gear (not shown) is connected to the spindle. Teeth of the pinion gear operably engage the teeth 58 of tooth gear 56. As the turntable 28 is supported on the kingpost 14, rotation of the pinion gear by motor 106 results in rotation of the turntable 28 and the kingpost 14 in relation to the sleeve 16, the motor 106 and pinion revolving around the circumference of the tooth gear 56.

Referring again to FIG. 1, a hydraulic connector 110 is attached to the lower end of kingpost pin 76. Hydraulic hoses 108 extend from hydraulic connector 110. The hydraulic hoses 108 extend to pumps and reservoirs (not shown) for hydraulic fluid, which pumps and reservoirs are of conventional construction. The hydraulic connector 110 is connected to additional hydraulic hoses (not shown) extending internally of kingpost pin 76 and elongated cylinder 80, the hydraulic hoses extending to hydraulic ram 42 and motor 108. The hydraulic connector allows for connection of hoses interior of the kingpost 14, which hoses rotate with the kingpost 14, to hoses exterior of the kingpost 14, which hoses are relatively stationary. The hydraulic connector 110 is a commercially-available product appropriate for fluid connection of hydraulic hoses such as the present application.

The upper bearing shoes 88 and the lower bearing block 98 are constructed of a solid lubricated or self-lubricating nonmetallic material suitable for bearing interface with a metal. A lubricated nylon material such as a nylon material impregnated with molybdenum disulfide sold by Polymer Corporation of Reading, Pa. under the trademark NYLATRON® has been found to be a suitable material for the bearing shoes 88 and the lower bearing block 98. A ultra high molecular weight polyolefin material may also be used.

Referring to FIG. 4, a plurality of alignment openings 120 are provided in the cylinder wall 54 of the sleeve 16 intermediate the cross-member 62 and the tooth gear 56. Cylindrical bosses 110 are affixed to the cylinder wall 54 at the openings 108, the bosses 110 having threaded openings concentrically arranged with openings 120. Two upper openings 120 and bosses 110 are provided near the upper end 26 of the cylinder wall 54 and two lower openings 120 and bosses 110 are provided near the lower end 64 of sleeve 16. The upper openings 120 are spaced angularly from each other and the lower openings 120 are spaced angularly from each other.

Upon installation of the kingpost 14 within sleeve 16, the kingpost 14 is rotatably supported within sleeve 16. The kingpost 14 is supported on upper surface 118 of bearing block 98. Bearing block is in turn supported on bearing retainer 102. The kingpost 14 is restrained from horizontal displacement at its upper end by bearing shoes 88 and is restrained from horizontal displacement at its lower end by bearing block 98. The bearing block 98 therefore serves as a lower radial bearing and as a thrust bearing.

The upper bearing shoes 88 of the present invention may be readily installed and replaced by raising the kingpost 14 upward until the bearing housings 94 are above the upper end of the sleeve 16. Such raising may be accomplished by placing a suitable jacking device below the kingpost pin 76 and jacking the kingpost 14 upward. The existing bearing shoes 88 may then be removed from the bearing housings 94. Replacement bearing shoes 88 may then be installed. Upon installation of the replacement bearing shoes 88 the kingpost 14 may be lowered such that the bearing shoes 88 are intermediate the kingpost 14 and the sleeve 16. The bearing shoes 88 need not be attached to the kingpost 14 by means other than insertion in the housings 94 as they are retained in place by the cylinder wall 54 of sleeve 16.

The lower bearing block 98 may be readily installed and replaced. Upon insertion of the kingpost 14 into sleeve 16 without the bearing block 98 and lower bearing retainer 102 installed, the kingpost pin 76 extends through square opening 66 and the kingpost lower end 78 rests on cross-member 62. The position of the kingpost 14 within sleeve 16 may be laterally adjusted by means of alignment openings 120 and bosses 110. Specifically, threaded alignment bolts (not shown) may be threaded into bosses 110. An alignment bolt may be threaded through a boss 110 until the bolt engages the kingpost body 72 and horizontally displaces the kingpost 14 in a desired direction. As a plurality of bosses 110 are provided, various bosses 110 and alignment bolts may be concurrently used to center the kingpost 14 within sleeve 16.

Upon centering of the kingpost 14 within sleeve 16, the lower bearing block segments **98*a* and 98*b* may be inserted in the square opening 66, within the annular opening 100 around the kingpost pin 76. Lower bearing retainer 102 may then be placed against the underside of bearing block 98 and bolts (not shown) inserted through the bolt holes 104, the bolts extending to corresponding bolt holes 68 in cross-member 62. As the bolts are threaded through bolt holes 68, the bearing block 98 and the kingpost 14 are raised. By threading the bolts until bearing retainer 102 is adjacent the underside of cross-member 62, the kingpost lower end 78 is supported on the upper surface 118 of bearing block 98 above the cross-member 62**. The alignment bolts may then be removed.

It will be seen that the upper bearing structure 22 and the lower bearing structure 24 each provide dynamic interface of metal to a relatively soft bearing material such as NYLATRON®. It will be further seen that a failure of the upper bearing 22 or of the lower bearing 22 will not result in overturning of the kingpost crane 10 due to the relatively close fit of the kingpost 14 within the sleeve 16.

The present invention has been described in terms of a preferred embodiment of a cylindrical kingpost 14 and a cylindrical sleeve 16. A non-cylindrical kingpost or a non-cylindrical sleeve may be practiced within the concept of the present invention, with appropriate substructures to allow for a circular upper bearing interface.

While the present invention has been described in terms of a preferred embodiment, it should be understood that within the scope of the appended claims the invention may be practiced otherwise than as specifically described.

I claim:

1. An inverted kingpost crane comprising:

a vertical, elongated sleeve having a vertical sleeve axis;

said sleeve including a cross-member vertically spaced from an upper end of said sleeve;

an axial cross-member opening extending vertically through said cross-member;

a vertical, elongated kingpost having a vertical kingpost axis;

said kingpost rotatable within said sleeve;

upperworks, including boom, mounted on said kingpost;

upper bearing means intermediate said kingpost and said sleeve;

lower bearing means comprising a bearing block;

said bearing block slidably positioned in said cross-member opening;

a bearing block retainer removably affixed to said cross-member;

said bearing block retainer positioned and constructed to provide vertical support for said bearing block and selectively maintain said bearing block in said cross-member opening;

thereby said bearing block may be removed and installed in said cross-member opening without removal of said kingpost from said sleeve;

said bearing block extending above said cross-member when operatively positioned in said cross-member opening; and thereby a bearing block upper surface contacts a kingpost lower surface.

2. An inverted kingpost crane according to claim 1 wherein said bearing block supports said kingpost and provides an axial bearing of the lower bearing means.

3. An inverted kingpost crane according to claim 2 wherein said bearing block comprising material that is relatively soft in relation to said kingpost and said sleeve.

4. An inverted kingpost crane according to claim 3 wherein said bearing block comprising a lubricated solid.

5. An inverted kingpost crane according to claim 2 wherein a center pin extending downwardly from said kingpost;

a vertical block opening provided in said bearing block;

said kingpost center pin extending through said block opening; and said vertical block opening engaging said center pin to provide a radial bearing of the lower bearing means.

6. An inverted kingpost crane according to claim 5 wherein said cross-member opening and said bearing block are constructed to prevent the lateral movement of said bearing block.

7. An inverted kingpost crane according to claim 6 wherein said cross-member opening and said bearing block are constructed to prevent the rotation of said bearing block.

8. An inverted kingpost crane according to claim 6 wherein said cross-member opening having a noncircular cross-sectional shape; and said bearing block having an outer cross-sectional shape that mates with said cross-member opening to prevent rotation of said bearing block.

9. An inverted kingpost crane according to claim 8 wherein said cross-member opening cross-sectional shape is square; and said bearing block outer cross-sectional shape is square.

10. An inverted kingpost crane according to claim 8 wherein said bearing block comprises two symmetrical pieces that form a segmented box when operatively positioned; and thereby said bearing block is easily positioned in said cross-member opening about said center pin when said kingpin is positioned in said sleeve.

11. An inverted kingpost crane according to claim 1 wherein said upper bearing means including a plurality of bearing shoes intermediate said kingpost and said sleeve, said plurality of bearing shoes comprising material that is relatively soft in relation to said kingpost and said sleeve.

12. An inverted kingpost crane according to claim 11 wherein said plurality of bearing shoes comprising lubricated solids.

13. An inverted kingpost crane according to claim 11 wherein said upper bearing means further comprises a plurality of shoe retainer means for retaining said plurality of bearing shoes to an exterior surface of said kingpost;

said plurality of bearing shoes engaging said sleeve to provide a radial bearing of the upper bearing means between said kingpost and said sleeve.

14. An inverted kingpost crane according to claim 13 wherein said plurality of shoe retaining means comprises a plurality of bearing housings; and said plurality of bearing housings constructed to slidingly receive and maintain said plurality of bearing shoes therein.

15. An inverted kingpost crane according to claim 1 wherein a kingpost center pin comprising a hollow cylinder;

said kingpost center pin extending to said upperworks; and said kingpost center pin providing a conduit between said upper works and a lower end of said kingpost.

16. An inverted kingpost crane according to claim 15 wherein said kingpost center pin is fixedly attached to said upperworks; and thereby said kingpost center pin rotates with said kingpost and said upperworks.

17. An inverted kingpost crane according to claim 1 wherein a toothed flange provided exterior of said sleeve at an upper end of said sleeve;

a motor fixedly mounted on said upperworks;

a gear operable by said motor engaging said toothed flange; and operation of said motor to rotate said gear inducing rotation of said kingpost within said sleeve.

18. An inverted kingpost crane according to claim 1 further comprising a plurality of threaded alignment openings provided in said sleeve;

a plurality of alignment bolts for threaded engagement with said plurality of alignment openings;

whereby said plurality of alignment bolts may be threaded through said plurality of alignment openings to engage an exterior surface of said kingpost to horizontally displace said kingpost to an axially aligned position whereby said kingpost axis is aligned with said sleeve axis; said plurality of alignment bolts removable upon accomplishing said axial alignment.

19. An inverted kingpost crane according to claim 1 wherein said bearing block having a vertical thickness greater than the vertical thickness of said cross-member.

20. An inverted kingpost crane according to claim 1 wherein said kingpost comprises a cylindrical body;

said sleeve having a cylindrical shape;

said kingpost and said sleeve concentrically arranged and defining an annular opening therebetween;

said annular opening relatively small compared to the diameter of said kingpost and said sleeve; and thereby said kingpost is maintained in said sleeve in the event of failure of the upper bearing means or the lower bearing means.

* * * * *